US007299849B2

(12) United States Patent
Haney

(10) Patent No.: US 7,299,849 B2
(45) Date of Patent: Nov. 27, 2007

(54) GARAGE DOOR, SCREEN STORING SYSTEM

(76) Inventor: Marrell Haney, 1301 W. 96th St., Chicago, IL (US) 60643

( * ) Notice: Subject to any disclaimer, the term of this patent is extended or adjusted under 35 U.S.C. 154(b) by 0 days.

(21) Appl. No.: 11/113,851

(22) Filed: Apr. 25, 2005

(65) Prior Publication Data

US 2005/0236118 A1 Oct. 27, 2005

Related U.S. Application Data

(60) Provisional application No. 60/565,477, filed on Apr. 27, 2004.

(51) Int. Cl.
*A47H 1/00* (2006.01)

(52) U.S. Cl. ..... 160/31; 160/89; 160/195

(58) Field of Classification Search ..... 160/89, 160/23.1, 349.1, 24, 26, 29, 31, 239, 194, 160/195

See application file for complete search history.

(56) References Cited

U.S. PATENT DOCUMENTS

| | | | | | |
|---|---|---|---|---|---|
| 972,422 | A * | 10/1910 | Whitmore | 160/287 |
| 2,094,790 | A * | 10/1937 | Gottert | 160/31 |
| 4,673,019 | A * | 6/1987 | Silverthorne et al. | 160/268.1 |
| 4,846,241 | A * | 7/1989 | Chomka et al. | 160/23.1 |
| 4,953,609 | A * | 9/1990 | Annin et al. | 160/24 |
| 5,671,790 | A * | 9/1997 | Andersen et al. | 160/24 |
| 5,988,256 | A * | 11/1999 | Winters | 160/310 |
| 6,053,235 | A * | 4/2000 | Ruffner, Sr. | 160/89 |
| 6,070,640 | A * | 6/2000 | Miyagawa et al. | 160/121.1 |
| 6,098,698 | A * | 8/2000 | King-Darr | 160/290.1 |
| 6,705,378 | B1 * | 3/2004 | Smidt | 160/120 |
| 6,873,461 | B1 * | 3/2005 | McPherson, Jr. | 359/461 |
| 6,877,548 | B1 * | 4/2005 | Chartier et al. | 160/178.1 V |

* cited by examiner

*Primary Examiner*—Blair M. Johnson

(57) ABSTRACT

The present invention provides a garage door screen storing system that is adapted for permanent mounting onto the exterior wall above a garage door. An aluminum steel cabinet with several advantages, including an electric moter being the power source that propels the main screen power rod which rotate the garage screen in and out of the screen storing units; It is equipped with devices that provide remote or manual activation for the screen and lighting of the designed light fixtures. The doors that closes at the bottom of the cabinet are adapted to rotate roller devices inside of metal tracks devices that are designed to contain the rollers as they are manipulating the screen guide landing rod in and out of the system. When the doors are opened to a vertical position, they served as retention tracks that are adapted to keep the garage screen nestled against the exterior walls of garage doors. The screen having a top connecting rod with metal rings in which are inserted metal flexible pins snapped, snaps firmly into place onto the main screen power rod.

1 Claim, 8 Drawing Sheets

35

34

30
30a
30d
25-a
25
32
30c 30
2
30
30c 26
33
31

GARAGE DOOR, SCREEN STORING SYSTEM

RELATED APPLICATION

This is a continuation of application Ser. No. 60/565,477, which was filed on Apr. 27, 2004, and entitled A Garage door screen storing system and the disclosure of which is incorporated by reference.

BACKGROUND OF THE INVENTION

1. Field of the Invention

The present invention relates to a motor driven roll up screen device that is innovated in it's features and functions, and as a multi functioning exterior garage door screen device system, and is permanently attached on the inside of a decorative secure compartment of which is permanently attached on a horizontal line above garage doors and having a diametrical width that is identical to that of garage doors.

2. Description of the Prior Art

Numerous problems are encountered by most prior Art that relate to functions, features and acceptable methods for storing their screen.

U.S. Pat. No. 1,110,857 August 1914 Applas 160/330
U.S. Pat. No. 1,972,539 September 1934 Simpson 160/328X
U.S. Pat. No. 1,954,813 April 1934 Harris
U.S. Pat. No. 3,640,332A February 1972 Luby et al 160/133
U.S. Pat. No. 4,250,676A February 1981 Presby 52/222
U.S. Pat. No. 6,705,378B1 March 2004 Brian Some methods that were used presented unsightly experiences for consumers which had integrated overhead screen units in existing garage door systems that were on the inside rails by installing swinging screen frames into garage doors openings, and by installing hinged apparatus to doors to be pivoted inward. Another screen system that presents a permanent eye sore is found in the method of permanently attaching screen units onto the inside of garage doors which leave a bulky and unprotected screen device storied at the side onto exterior walls.

SUMMARY OF THE INVENTION

Accordingly, the present invention recognizes the above problems in prior Art and provide an innovative screen storing unit that is adapted for exterior use above garage doors which is likely to increase the acceptance of permanently attached screen devices on exterior walls above garages. A main objective of the present invention is to provide a durable system that is inexpensive to build and maintain. Another objective is to provide an attractive screen storing device with locking mechanisms for the two security doors that can be pivoted vertically, and extending to the apron on special tracks that are attached to the compartment door, and are adapted for opening to a vertical direction and are thereby used to provide vertical tracks for the rotating the screen devices. The present invention having an electric motor that drives a main power rod can also be activated by remote or by manually controlling the downward movements to the apron or upward into the screen storing compartment where it can be is secured on the inside of the system during periods when it is not in use. The aluminum steel security equipped with several devices that allows the garage screen to be nestled against the outer walls of garage doors as it is rotated in and out of the garage screen storing compartment. Preferably, aluminum steel, plastics and high grade lumber along with nuts and metal screws, brackets; and leathery materials are provided for constructing the system. A metal top connecting rod consists of regressive rings are adapted for attaching to metal flexible pens. There is a twin metal bar combination with several pouches that are suited for chip metal or sand pebbles which could be used as weight sources on a landing guide rod. The present invention is for permanently storing in an aluminum steel compartment, on the exterior wall above garage doors. The present system is inexpensive to build and maintain and can be easily attached. Further, the present invention which consists of innovated component devices, that include multi purpose doors having metal tracks, and a screen guide device that protects the screen as it is rotated in and out of the screen compartment. Night lights that are attached on the interior and exterior sides of the compartment and are remotely activated are generally that can be activated by remote and sensor controls which are safe to operate around children and pets. The present invention promotes the splendor and beauty of various species including the images of birds and animals.

BRIEF DESCRIPTION OF THE DRAWINGS

The above and other objects, features and other advantages of the present invention are described in detail descriptions and will be more clearly understood in conjunction with the accompanying drawings in which:

FIGS. 5, 5*a*, 5*b* and 5*c* are the views to the power rod.

DETAILED DESCRIPTION OF THE DRAWINGS

Figure 1:
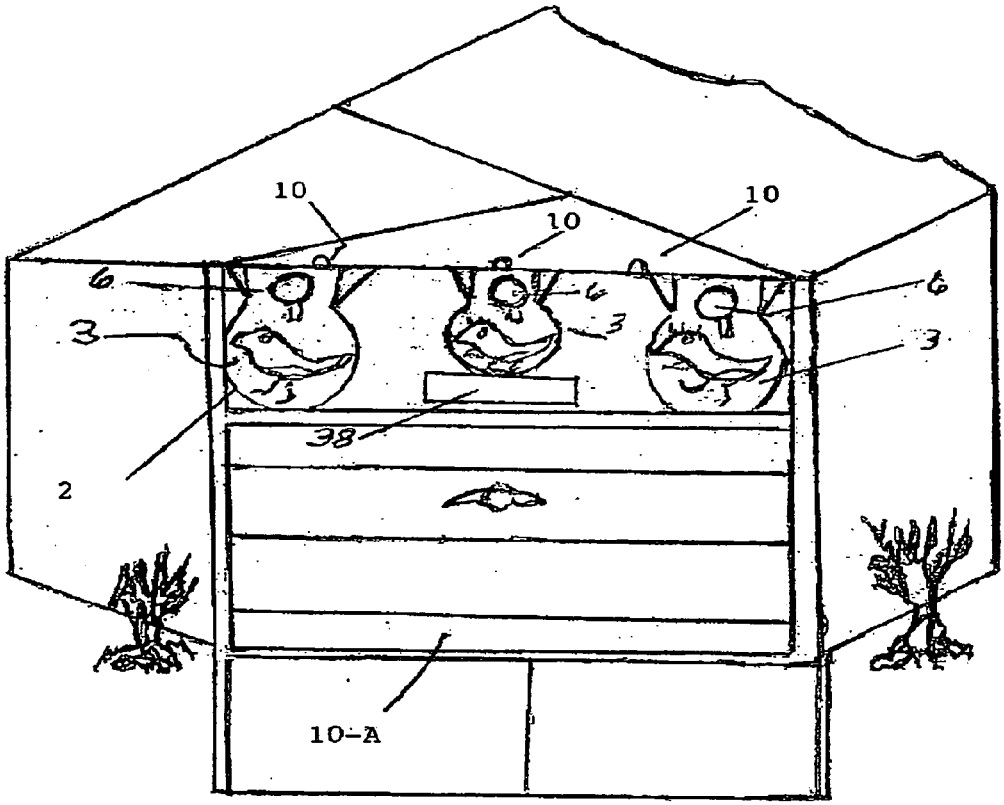
FIG. 1 is a perspective view showing the present invention that is adapted for mounting onto exterior walls above garage doors as seen in FIG. 1.
Figure 2:
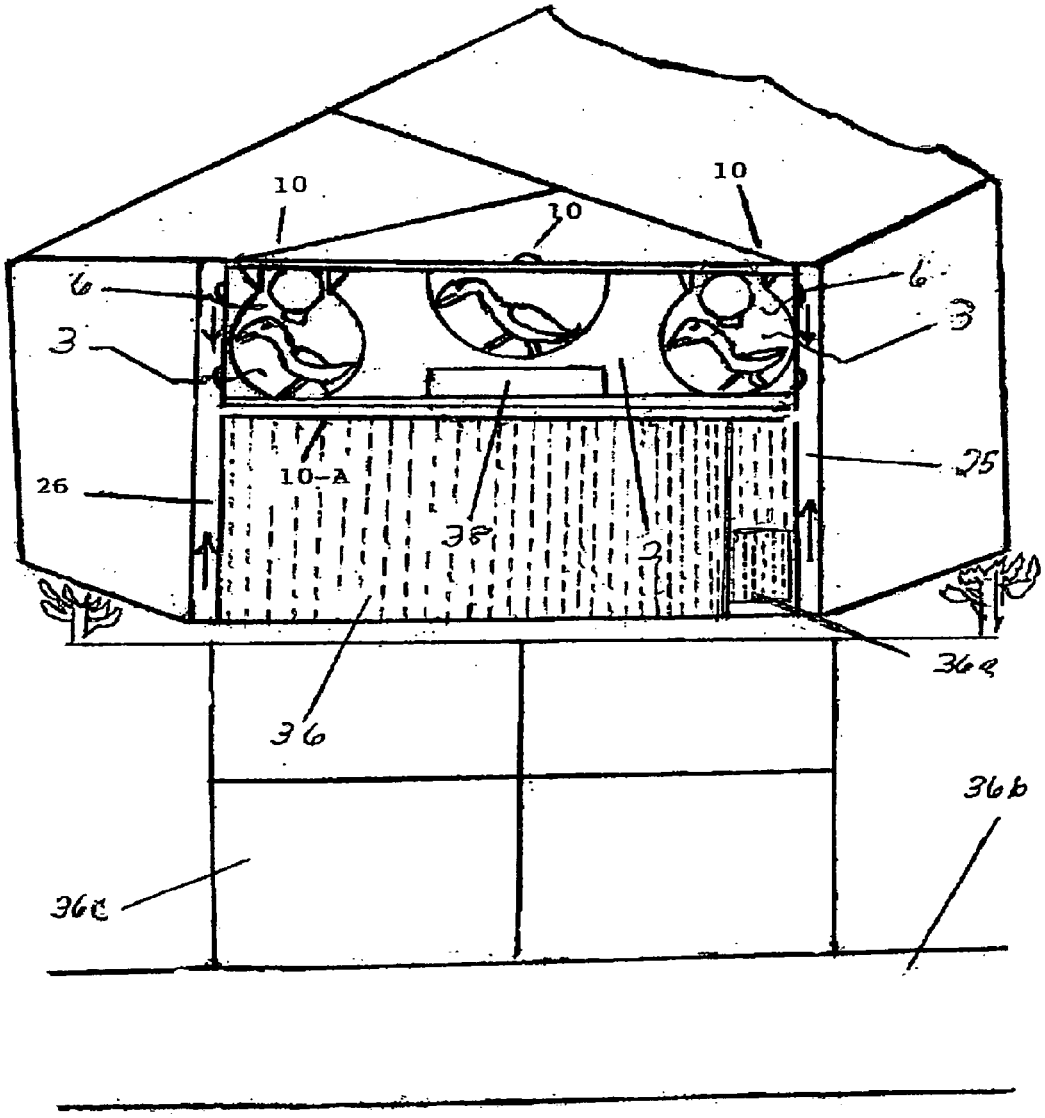
FIG. 2 is a perspective view of the garage screen device as it appears on an exterior wall above a garage door during periods when it is in an open position.
Figure 3:
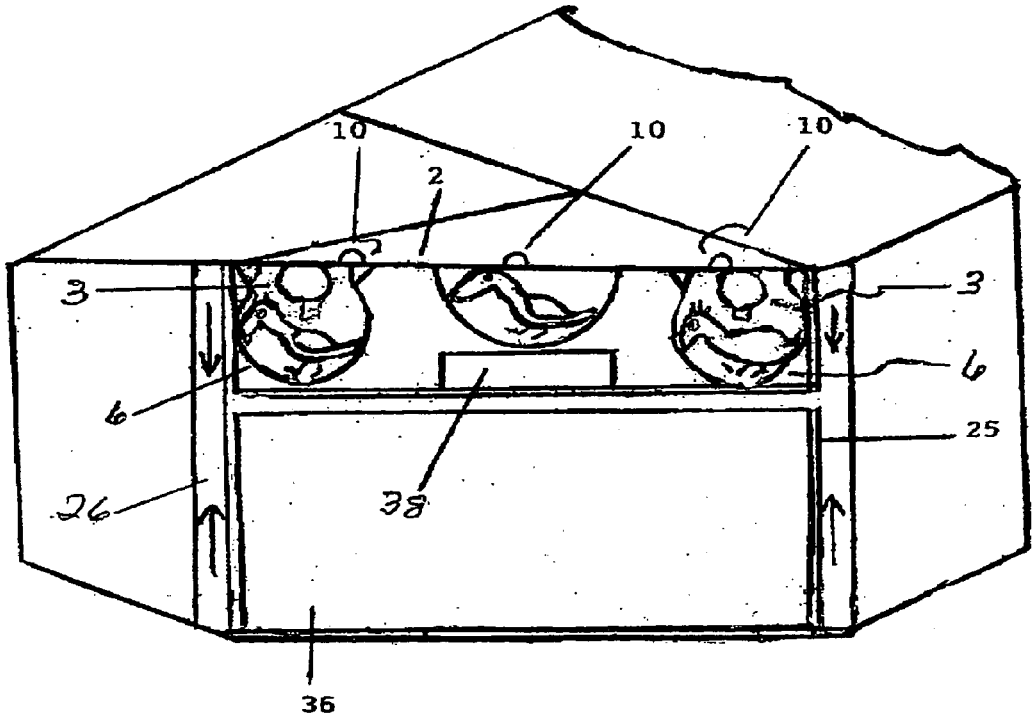
FIG. 3 is a perspective view showing a garage door screen with a second door that is provided with over lapping screen materials as it is seen in a lowered position.

Referring to FIG. 1 is a frontal view of the present invention 2 as it is seen mounted on the exterior wall above closed garage door 10*a*. Compartment 2 is covered with aluminum paneling and, is attached to the exterior wall by inserting several metal bolts inserted through pre drilled ½ inch holes that originate on the exterior wall and extend to the interior side of the wall, and are thereby secured with a metal lock washers and nuts. Screen storing compartment 2 can also be attached to the wall by using metal screws that are approximately 2 inched in length, and also for attaching compartment 2 onto mounted brackets. The perspective in FIG. 2 depicts the garage door storing compartment 2 with name plate 38 which is attached to compartment 2 with welding products or by using small metal screws along with connectors 10 to mount the compartment in a horizontal position on the exterior wall above an opened garage door. As shown in FIG. 3 a garage screen 36 having a second source of egress 36*a* and the lead landing rod with weight pouches 21*a* have been lowered from system 2 to the apron. Aluminum metal, plastics, and other steel products including nuts and bolts are suitable materials for use in constructing the system.

Figure 4:
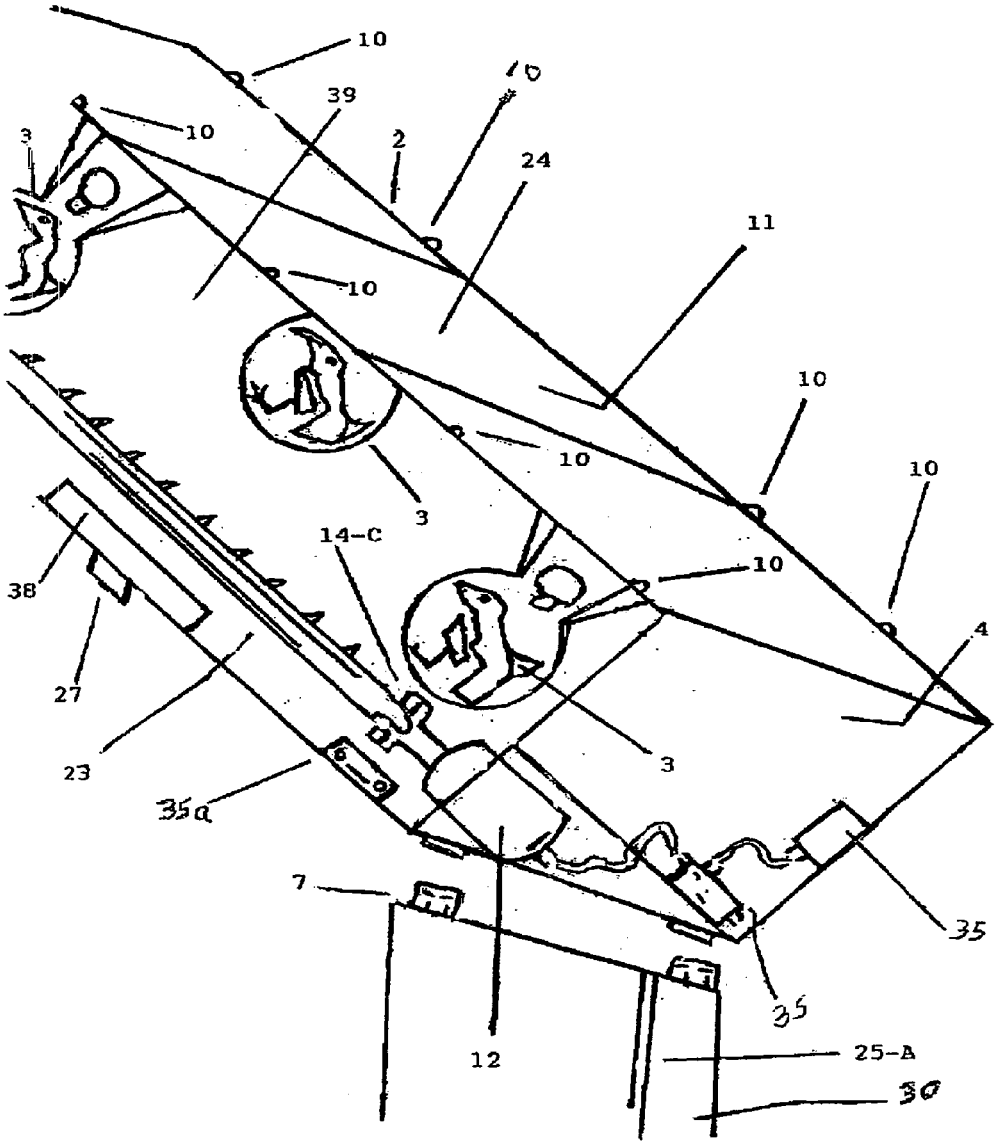
FIG. 4 is a perspective view of the garage door screen storing compartments showing an electric motor that is attached to the main screen power rod.
Figure 5A:
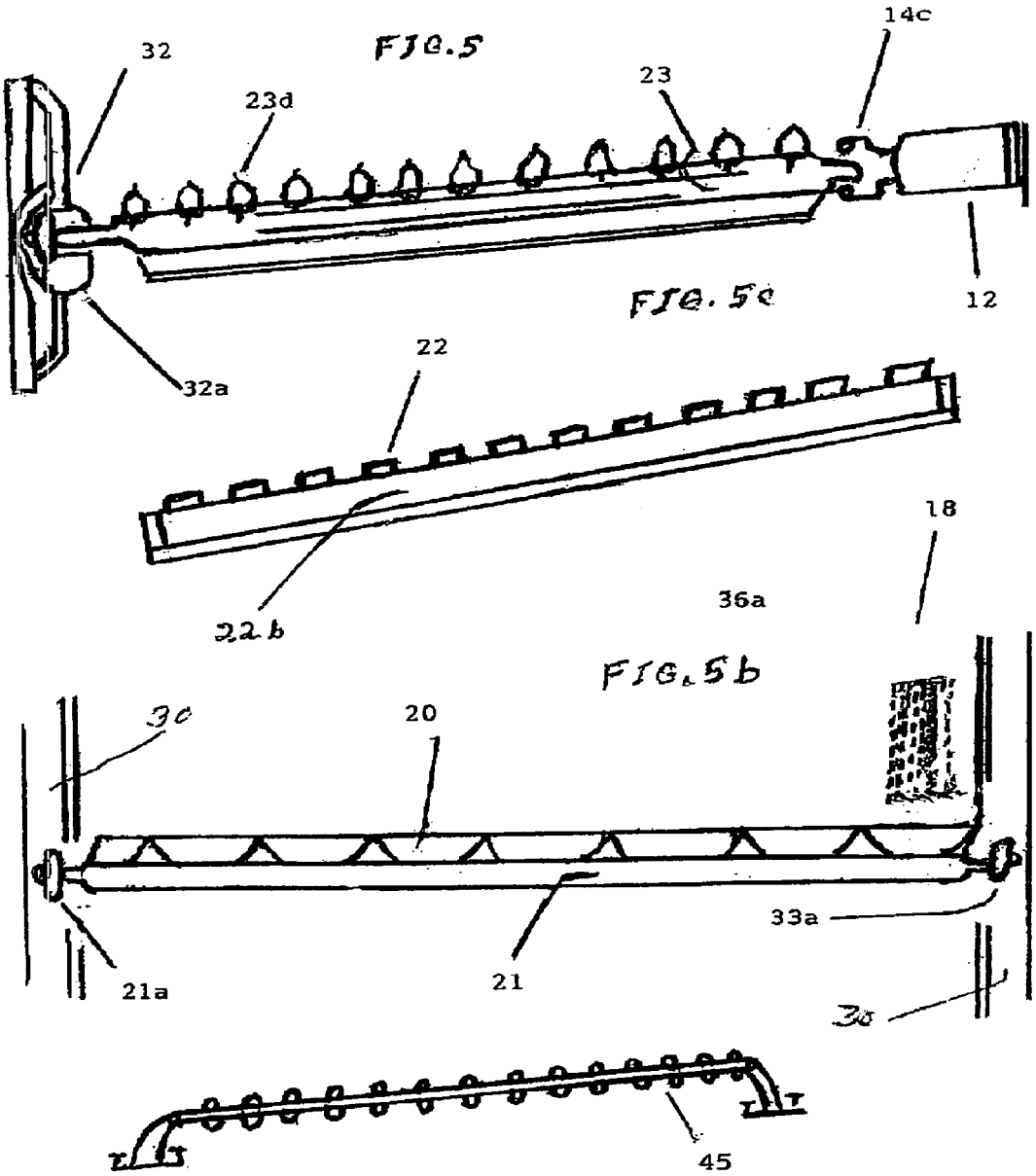
Figures 6, 8, 9, 10, 11, 13:
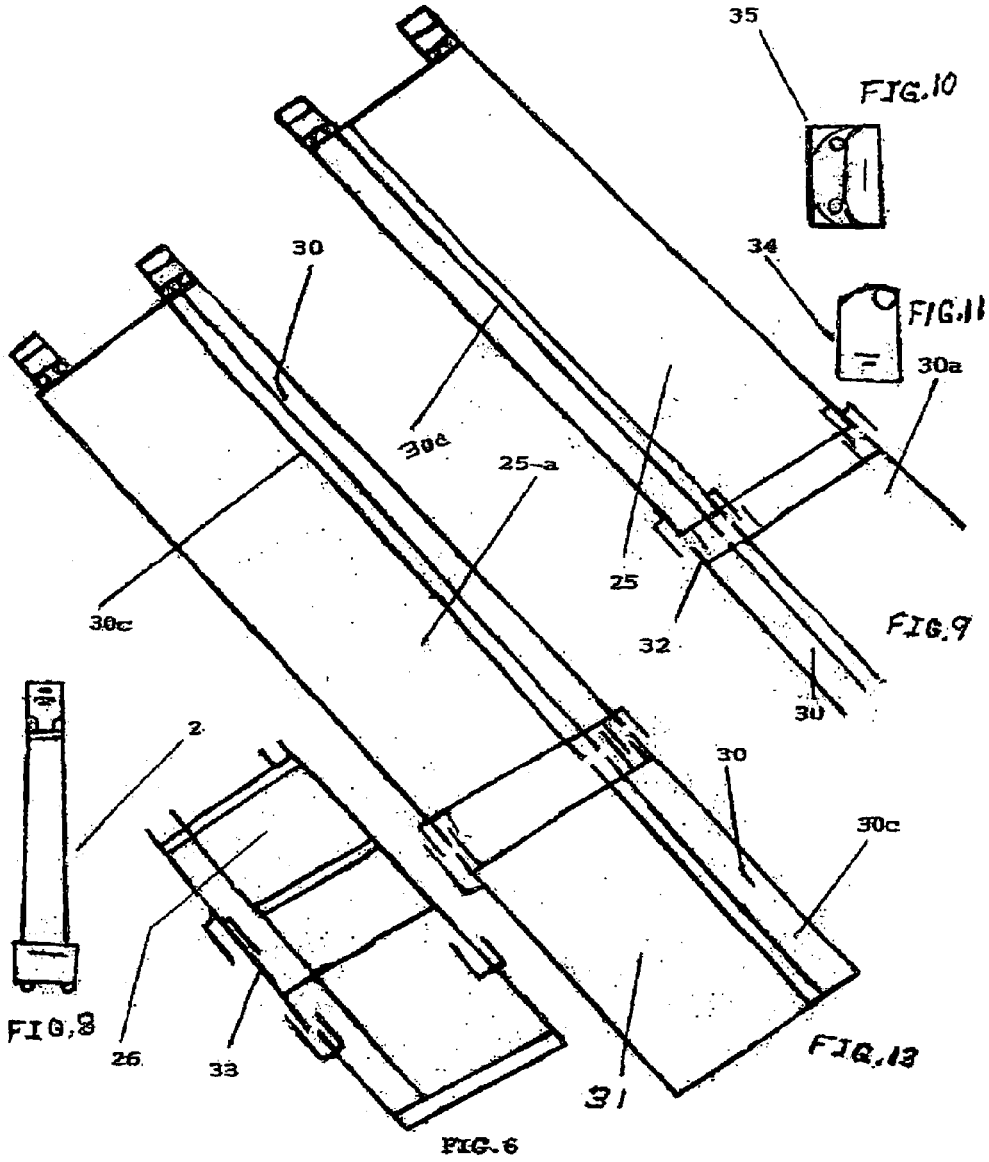
FIG. 6 is a perspective view showing a left door and a right door and also included are extension door slats.
FIG. 8 is a perspective of a metal bar that is provided as a lock component.
FIG. 9 is a perspective showing a right side compartment door.
FIG. 10 is a perspective of a relay.
FIG. 11 is a perspective showing a relay control device.
FIG. 13 is a perspective view showing a left side metal compartment door.

Referring to FIG. 4 is a partial view of garage door screen storing system 2 which consists of an aluminum steel compartment 2, and is adapted for size adjustments, and is preferably 18 inches in vertical height, and 12 inches in width and 12 feet in length. The system consists of images of species including birds and animal designs in light fixtures 3 on the front center panel and the left and right sides which are generally attached with molding product. A name plate 27 is provided on the front side of compartment 2 which consists of a left side panel 33, right side panel 4 and a back side panel 11, and is sealed on the top side panel 24 consisting of a measurement of approximately 12 inches deep and 12 feet long. Materials including corner brackets, sealants, and metal screws are provided. The horizontal top panel 24 being about ½ inch thick and having a measurement of 12 inches wide, and having a horizontal length of approximately 12 feet. A process of welding together various bars and panels is another method that may be used for constructing the compartment structurally. Thus, a series of component devices are provided including electricity that is needed in order to generate power to devices that include relay 35 in FIG. 10 and remote control 34 in FIG. 11 which transfers electrical current to switch devices for activating an electric motor 12 and thereby causing the screen power rod 23 to rotate as desired to move the screen in and out of the compartment. Some features for use in the system include images of various species and light fixtures and 1 which are adapted to be activated remotely or by manually using light switch 6. Small metal screws are preferably used for attaching switches, name plate and light fixtures 3 and 1. Referring to FIG. 5 are component devices consisting of main screen power rod 23, being approximately 2 inches in diameter connects to a motor drive coupling 14*c* to power rod 23. In addition, the screen landing rod 21 that is equipped with pouches 20 to be used for weight devices. The garage screen being made of-preferred nylon material and consisting of a second door of egress 36*a* which is equipped with over lapping borders 18 is joined to connecting rod 22*b* and to the bottom landing guide rod 21 that is adapted for maneuvering the screen on rollers 21*a* as they rotate inside of vertical metal tracks devices 30 for vertical and as seen in FIG. 6, the aluminum metal doors 25 and 25*a* having metal track devices 30 for vertical rollers 21*a* and 33*a* are preferably attached to the security compartment 2 having multipurpose doors 25 and 25*a* which are attached to the compartment 2 with metal hinges 30*b* at the left and right sides onto the lower horizontal surface area of compartment 2. Remote devices 34 and 35 are among several component parts that are shown in FIG. 6. The door extension slats 26, 30*a*, 31 and 33 are designed to provide additional length for extremely high doors.

Flexible pins 23*d* snap into metal regressive rings 22 on connecting rod 22*b* as shown in FIG. 5.

Figures 7, 7A:
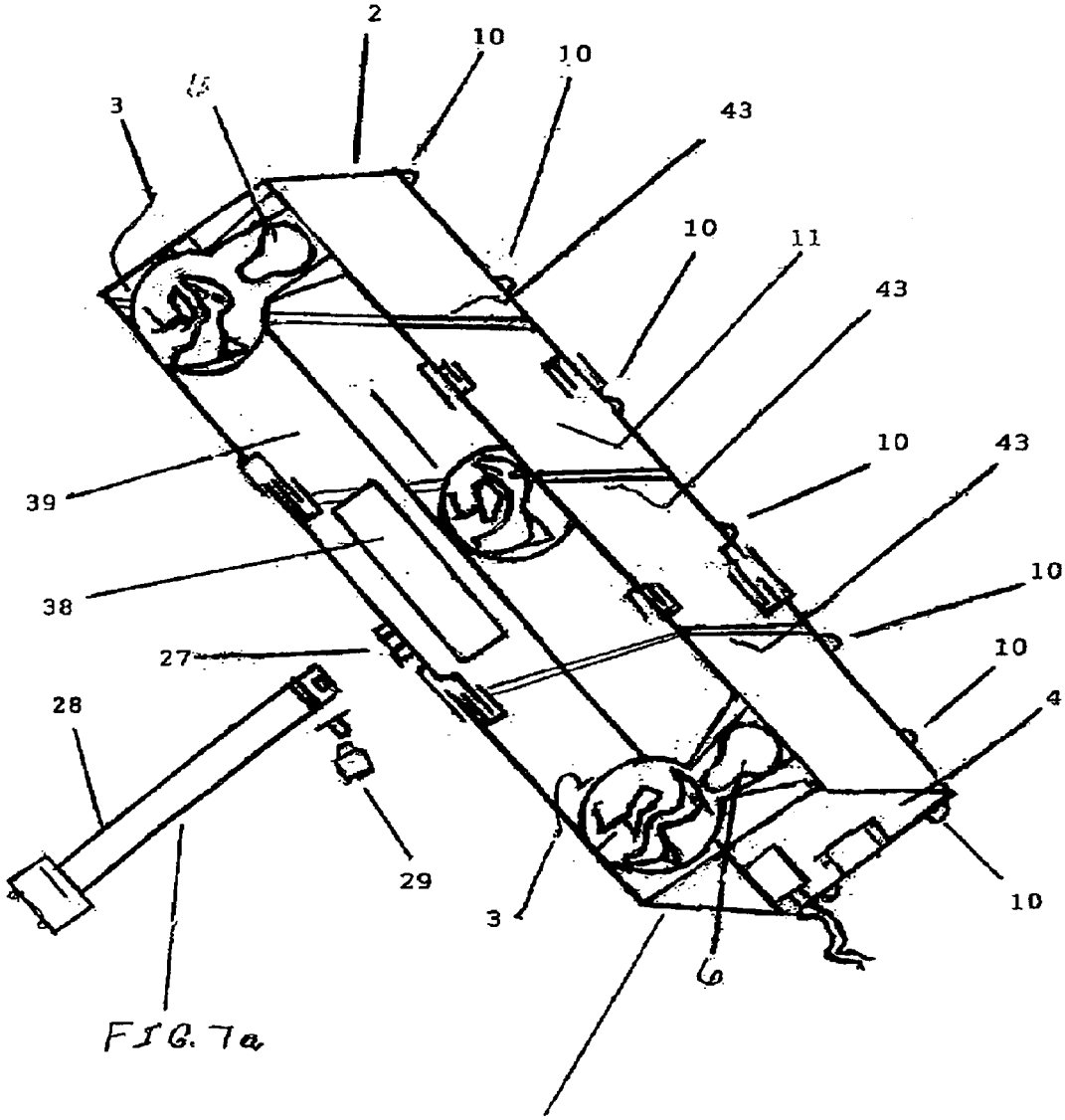
FIG. 7*a* is a perspective of a metal locking device.
Figure 12:
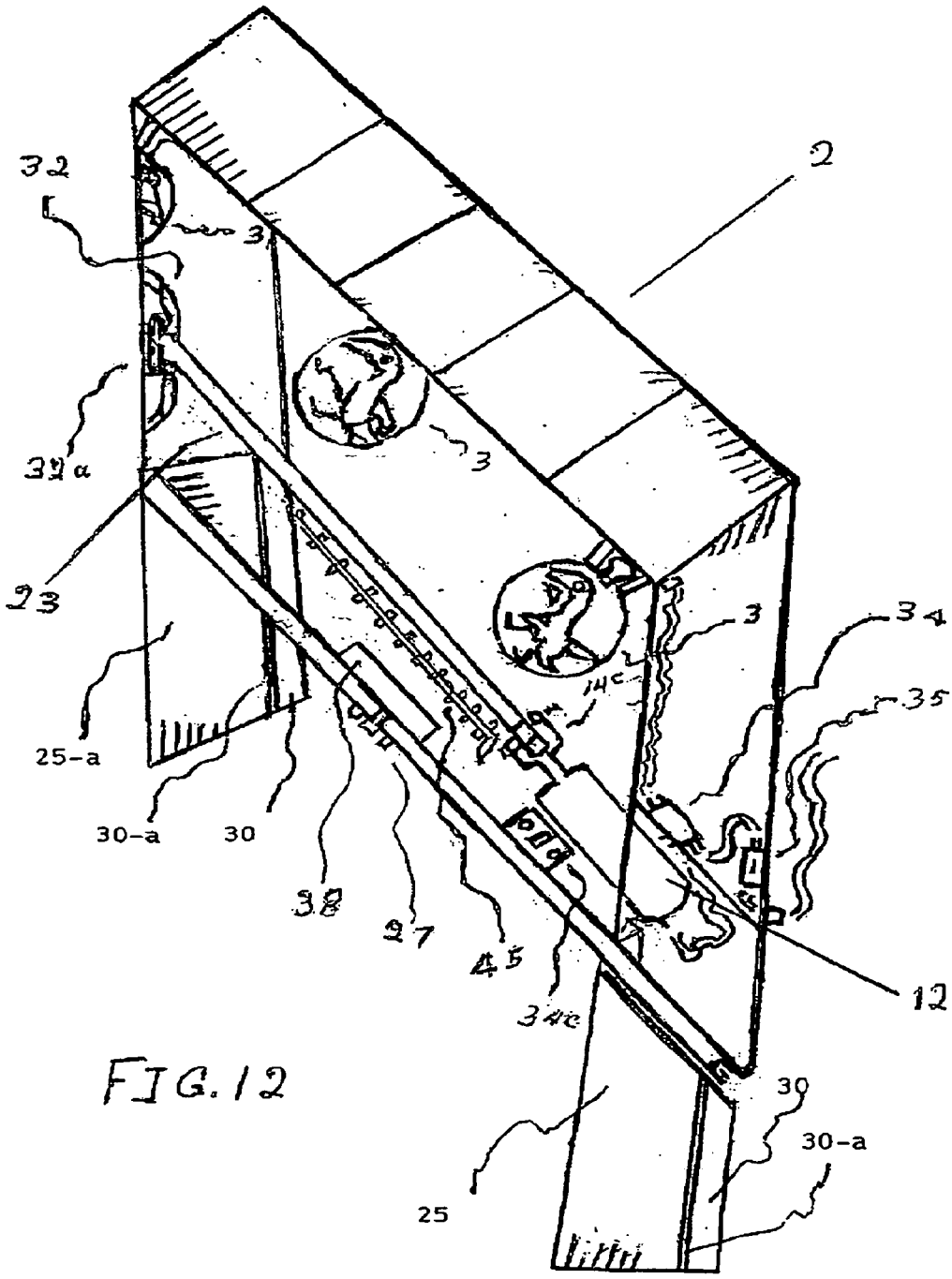
FIG. 12 is a perspective showing a full view of the garage door screen storing system

Referring to FIG. 6 are aluminum steel door 25 and door 25*a* which are adapted for several functions that enhance their mobility. For example, in addition to securely sealing the system when it is not in use, the doors which are designed with metal tracks to provided for rollers 21*a* and 33*a* which are attached to each end of the screen landing rod 21 contribute to vertical movements by keeping the screen in close proximity to exterior walls of garage doors. The rollers are attached on the inside of vertical metal tracks, and contribute to rotating the garage door screen. The doors are adapted for locking automatically remotely or manually from the bottom side at the center of the compartment with aluminum steel locking devices 27 and are adapted with hinge devices for attaching the doors to the compartment with metal screws. Referring to FIG. 7 is a perspective showing three sections of the system as being adapted for variations in packaging and shipments. The compartment is adapted for mounting compartment sections 10 to exterior walls of garages with attachable brackets and approximately 8 inches long metal bolts with nuts. The perspective has a left side 4, a right side 4*a* along with a top side 24 and a bottom side 39 and a back side 11. Although the garage door screen storing system is adapted to cover openings, it is preferably that the compartment's horizontal measurement is approximately 14 feet with a cabinet height of about 14 inches and approximately 12 inches deep for most compartments. Materials that are suitable for constructing of the compartment are preferably aluminum steel sheets. The horizontal sheets being two 12 inches wide for the top and bottom sides, and two aluminum steel sheets that measure about 14 inches wide. Again, each sheet should measure about 14 feet long. A process of welding and the use of metal screws are suitable methods for constructing corner sheets and bars, and two metal sheets for the left and right sides that are about 17 inches in width and 14 inches in height. A metal bracket 32 that is adapted to support the free end of the main screen power rod 23 is mounted at the opposite end of the compartment onto metal brackets. The relay and other electrical switches are also mounted in the right side of the compartment and preferably as shown in FIG. 4.

Further, the main screen power rod 23 has flexible pins 23*d* which are inserted into regressive rings 22 on the screen's top power rod 23. A variety of ways should be suitable for applying certain types of enamel paints through a process of baking at the time of constructing. A leather material for weight pouches is also suitable for screen borders on all four sides. The constructing measurements for the left and right sides, the top and bottom sides for the borders are approximately 4 inches wide with a horizontal and vertical measurement that equals that of the actual diametrical measurements of the garage. Accordingly, the process of rotating the screen in and out of the storing compartment enhanced with the use of spring-like cushing bar 45 which is installed by attaching each side to the left and right sides of the compartment on the inside at approximately 5 inches from the main power rod 23 and thereby allowing the bar to keep the screen nestled against the exterior walls of garages as it moves in a vertical direction toward the apron inside of metal tracks. The frame for the cabinet compartment requires a durable product that will accommodate the aluminum steel which are used for the corner and bars. Also, aluminum steel is suitable for brackets and horizontal bars being connected by welding and the use of metal screws. The inclusion of aluminum products will preferably result in a light weight structure for cabinet compartment 2 and maintain it's durable quality for exterior use. At least four bag being approximately 12 inches long are needed for horizontal use. Also required are four vertical bars being approximately 14 inches long with corner brackets and four horizontal bars being approximately 14 feet long are preferred for the constructing of the frame for compartment 2. The occasional adjustment of the cabinet compartment width is provided in order to accommodate unusual garage sizes.

What is claimed is:

1. A garage door screen storing system comprising:

A metal, elongate horizontal cabinet compartment having a top panel, a front panel, a back panel, opposing end panels and a bottom opening, the compartment adapted to be permanently mounted above a garage door opening on the exterior of a garage;

A pair of elongate doors, each door having a track extending the length thereof, each door hingedly connected at an end thereof to respective opposing ends of the compartment, the doors being foldable up to close bottom opening of the compartment and being foldable downwardly into opposing vertical positions on each side of the garage door opening;

A power rod mounted in the compartment, a motor connected to the power rod for rotating the power rod, the power rod having flexible pins extending therefrom along the length thereof;

A flexible screen having a top edge attached to the power rod for being rolled up onto and being unrolled from the power rod to raise and lower, respectively, the screen;

A connecting rod connecting the top edge of the screen to the power rod, the connecting rod being attached to the top edge of the screen and the connecting rod further having regressive rings extending therefrom along the length thereof through which the flexible pins snap, thereby attaching the connecting rod to the power rod;

A landing rod attached to a bottom edge of the screen opposite the top edge; the landing rod having rollers on opposite ends thereof which are guided in the tracks of the doors during raising and lowering of the screen;

Whereby when the screen is not in use, the doors may be folded up to close the compartment and when the screen is in use, the doors are folded down into their vertical position to thereby guide the screen.

* * * * *